United States Patent [19]

Jones

[11] Patent Number: 4,896,620

[45] Date of Patent: Jan. 30, 1990

[54] MARINE BUOY

[76] Inventor: Harry E. Jones, 9408 NE. 188th St., Bothell, Wash. 98011

[21] Appl. No.: 305,159

[22] Filed: Feb. 1, 1989

[51] Int. Cl.[4] ..... B63B 45/00

[52] U.S. Cl. ..... 114/253; 441/16; 441/23; 114/266; 114/267

[58] Field of Search ..... 441/1, 6, 11, 13, 21, 441/23, 28, 16; 114/121, 122, 266, 267, 242, 253; 116/26

[56] References Cited

U.S. PATENT DOCUMENTS

| | | | |
|---|---|---|---|
| 2,119,854 | 6/1938 | Day | 114/253 |
| 2,324,983 | 7/1943 | Gollings | 114/253 |
| 3,453,670 | 7/1969 | Conry | 114/253 |
| 3,474,750 | 10/1969 | Le Bleu | 114/253 |
| 3,707,736 | 1/1973 | Bass | 114/253 |
| 3,774,564 | 11/1973 | Bondon et al. | 114/16 R |
| 3,953,905 | 5/1976 | Paitson | 114/253 |
| 4,246,860 | 1/1981 | Saund | 114/253 |
| 4,291,484 | 9/1981 | Young | 441/16 |
| 4,464,129 | 8/1984 | Vancheri et al. | 441/16 |
| 4,668,200 | 5/1987 | Kotoh et al. | 441/7 |
| 4,763,126 | 8/1988 | Jawetz | 441/16 |

*Primary Examiner*—Joseph F. Peters, Jr.
*Assistant Examiner*—Clifford T. Bartz
*Attorney, Agent, or Firm*—Delbert J. Barnard

[57] ABSTRACT

A buoy (10) carries a light (16) at the upper end of a mast (14). The lower end of the mast (14) is connected to a buoyant body (12) which is weighted to present a maximum diameter zone (20) slightly below the water level when the buoy (10) is at rest in the water. The body (12) tapers inwardly both above and below the maximum diameter zone 20. A towing bar assembly (18) is provided on one side of the buoy (10). It includes an upwardly and outwardly sloping guide bar (30) connected at its upper end to a tow bar (36). An eye (50) at an end of a control line (46) is slidably received on the guide bar (30). An initial tug on the control line (46) causes the eye (50) to slide upwardly along the guide bar (30) until it engages a bight (38) of the tow bar (36). The bight (38) is positioned radially outwardly from the maximum diameter zone (20). Then, when the control line (46) is pulled upon, it pulls the buoy (10) into the water. Initial water movement acting on the lower portion of the buoy (10) raises the buoy (10) from the water. Then the buoy (10) moves in the water sideways while remaining substantially upright.

19 Claims, 7 Drawing Sheets

16
52
14
16
14
54

16
14
98
10
120
38
12

20
36
30
18
60
154
W
44
150
86
50
46
152

517
56
26
72
68
118
120
120
102
116
98
100
70
60
22
60
122
122
94
92
88
96
90
42
40
42
42
36
38
140
82
76
78
80
44
84
110
62
24
62
32
30
18
124
128
126
28
66
58
86

16
110
10'
98'
98'
176
196
196
188
188
12'
182
124
76
36'
194
194
194
126
192
180
190
190
184
178

16
14
10"
18
CG
36
200
198

MARINE BUOY

TECHNICAL FIELD

The present invention relates to marine buoys. More particularly, it relates to the provision of a marine buoy which can be towed and will remain substantially upright when towed, and to a marine buoy which combines together a plurality of functions in a simple and efficient manner.

BACKGROUND ART

U.S. Pat. No. 2,119,854, granted June 7, 1938 to Thomas O. Day discloses a light buoy comprising a body composed of upper and lower conical sections, a lantern head at the upper end of the upper section, and a ballast chamber and a wire bail at the lower end of the lower section. The buoy is hung at a convenient place aboard a vessel. When needed, it is removed from its hook and thrown overboard. The ballast in the lower end of the buoy rights the buoy and causes it to float with the lamp uppermost. A mercury switch in the buoy functions to light a bulb in the lantern head.

U.S. Pat. No. 3,324,983, granted July 20, 1943 to Archie H. Gollings discloses a buoy comprising a near spherical body which includes a central battery space, an annular air space surrounding the battery space, a light assembly at its upper end, and an eye at its lower end by which it is connected to an anchor chain.

U.S. Pat. No. 3,453,670, granted July 8, 1969, to Lloyd H. Conry discloses a buoy comprising a semispherical body, a mast extending upwardly from the body, a tube extending downardly from the body to an instrument chamber, and a control lanyard to which a mooring line is attached. A windmilling rotor is provided at the top of the mast. It functions, in response to the presence of a predetermined wind velocity, to exert a lifting force on the buoy sufficient to place the major portion of the buoy structure above the crests of passing waves.

U.S. Pat. No. 3,707,736, granted Jan. 2, 1973 to Robert C. Bass discloses a buoy having a disc-shaped body, a ballast chamber projecting below the body, a light positioned on top of the body and an anchor line secured to a lower central portion of the ballast chamber.

U.S. Pat. No. 3,774,564, granted Nov. 27, 1973 to Louis A. Bondon and Bruce B. Haselman discloses a submersible oceanographic vehicle. The vehicle comprises a disc-like body which may be ballasted to extend either horoizontally or vertically. The body may be towed by a tow line attached at an edge so that it can be towed with minimum drag and good stability.

U.S. Pat. No. 3,953,905, granted May 4, 1976, to John L. Paitson discoses a buoy comprising a vertically elongated tubular body having a signal light and a transmitter antenna at its upper end, and a hollow V-wing at its middle. A towing bridle extends forwardly from the opposite ends of the wing and from the lower end of the tubular body to a common point of connection with a tow line. Batteries and a ballast weight are placed within the lower portion of the body which extends below the wing.

U.S. Pat. No. 4,464,129, granted Aug. 7, 1984, to Patrice Vancheri and Henri Lefebvre discloses a buoy having a semispherical body, a mast extending upwardly from the body, a signal device at the upper end of the mast, and an anchor line connection on a lower portion of the body. The buoy body contains an electronic control which detects the presence of a danger in the water to divers and in response sends a signal to the divers and another signal to the crew of the divers' boat.

U.S. Pat. No. 4,668,200, granted May 26, 1987 to Keigo Kotoh and Nobuhiro Nakamura discloses a buoy having a battery compartment at its lower end, a buoyant material compartment above the battery compartment, a light at its upper end, and a control line eye on one side. The upper end of the buoy includes a receiving antenna for receiving radio waves, a searcher's radar and a transmitting antenna which transmits signals in response to the radio waves.

Despite the existence of the above-described prior art buoys, there is a need for a buoy which is simple to construct, is durable, is multi-functional and is readily towable and will remain in a substantially upright position when towed. A principal object of the present invention is to provide such a marine buoy.

DISCLOSURE OF THE INVENTION

One aspect of the invention is to provide a towable buoy which comprises a hollow buoy having an upper end and a lower end. The body includes a generally conical upper portion having a small upper end and a larger lower end and a generally conical lower portion having a large upper end and a small lower end. The lower end of the upper portion is joined to the upper end of the lower portion, providing the body with a maximum diameter where the upper and lower portions join. A control line guide bar is connected to the buoy and slopes upwardly and outwardly from its lower end adjacent the lower end of the body to its upper end. A tow bar is connected to the upper end of the guide bar. The tow bar presents a bight spaced radially outwardly from the maximum diameter of the body. A ballast weight provides the buoy with a center of gravity that is located below the maximum diameter of the body. A control line is slidably connected to the guide bar. In a first position, the control line is at the lower end of the guide bar. In a second position the towing line is in tension and engages the bight of said tow bar. When a towing force is first applied to the tow line, the tow line responds by sliding in position upwardly along the guide bar until it is in a position of engagement with said bight. Then, when the tow line is pulled upon an additional amount, the tow line exerts a towing force acting on said buoy substantially at the maximum diameter of the buoy. This application of the towing force, together with the shape of the body, results in the buoy remaining in a substantially upright position while it is being towed.

According to another aspect of the invention, a marine buoy is provided which comprises a hollow body having an upper end and a lower end. A relatively large opening is provided in the upper end and a relatively small opening is provided in a lower end. An inner housing is located within the hollow body. The inner housing is sized to fit through the opening in the upper end of the hollow body. The inner housing includes a tubular lower end portion which is sized to fit through the opening in the lower end of the body and then extend below the hollow body. A buoyancy chamber is defined by and between the inner housing and the hollow body, about the inner housing. A retainer member is secured to the tubular lower end portion after insertion of the inner housing into the hollow body and insertion of the tubular lower end portion through the opening in the lower end of the hollow body. A removable cap is secured to the upper end of the hollow body following insertion of the inner housing into the hollow body. The lower end of a mast is connected to the cap. A signal light is provided at the upper end of the mast. Batteries are contained within the inner housing. A circuitry interconnects the batteries and the signal light. Control circuitry may include an off-on control for the signal light which is mounted on the cap.

This construction of the marine buoy allows the hollow body, the inner housing, including the tubular lower end portion, the retainer member, the cap member and the mast to all be constructed from a lightweight structural plastic material. The mast, the inner housing, including the tubular lower end portion and the retainer member can all be constructed from readily available plastic components.

In accordance with an aspect of the invention, a pair of batteries are placed within the inner housing, a ballast weight is placed within the inner housing below the batteries, and control components are positioned within the removable cap, between it and the batteries. One of several types of radar antennas can be attached to the mast, below the light. The light may be adapted to blink on and off, or be continuously on.

Other more detailed constructional features of the buoy are hereinafter presented as a part of the detailed description of the preferred embodiment.

BRIEF DESCRIPTION OF THE DRAWING

In the drawing, like numerals refer to like parts throughout the several views, and.

BEST MODE FOR CARRYING OUT THE INVENTION

Figures 1, 2, 3:
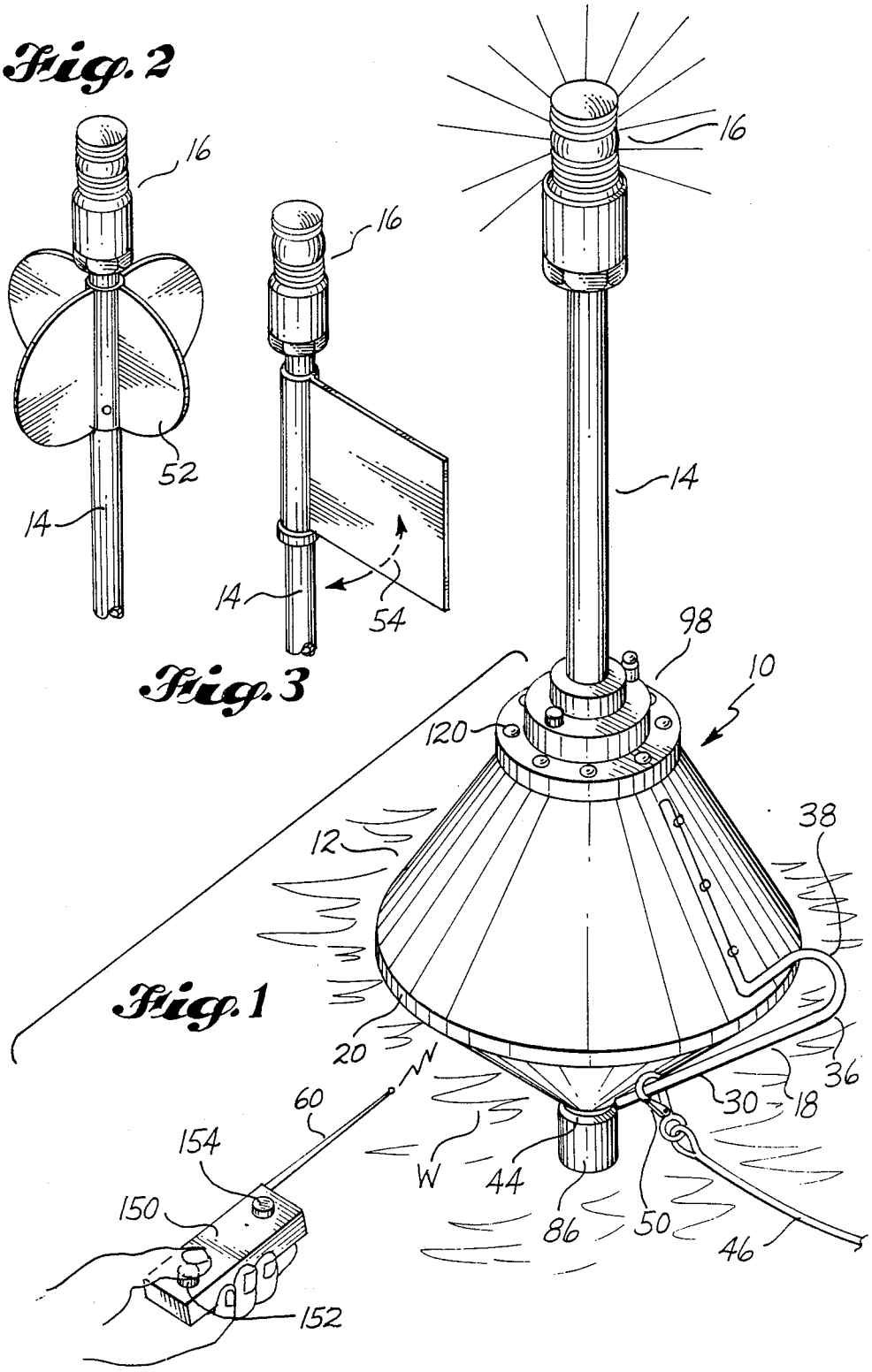
FIG. 1 is a pictorial view of a preferred embodiment of the invention.
FIG. 2 is a fragmentary pictorial view of the buoy shown by FIG. 1, showing a first form of radar reflector secured to the mast of the buoy, below a light at the upper end of the mast.
FIG. 3 is a view like FIG. 2, but showing a second form of radar reflector.
Figure 5:
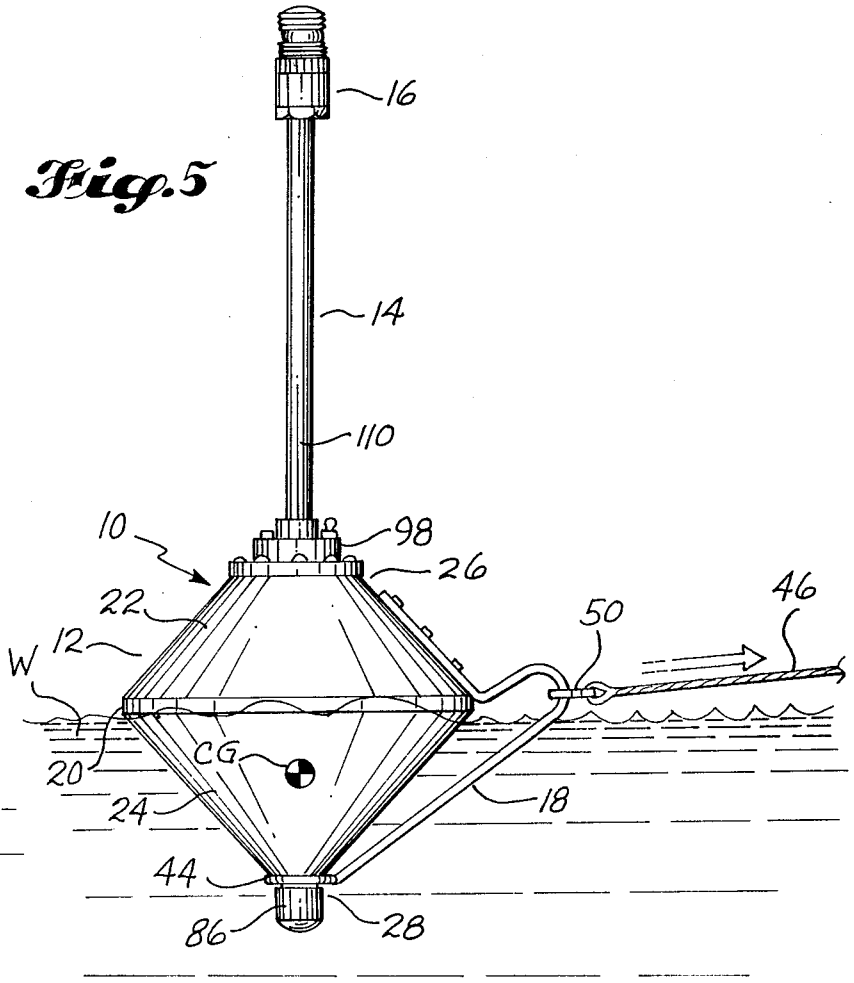
FIG. 5 is a view like FIG. 4, showing the buoy being towed by a tow line.

FIG. 1 shows a buoy 10 floating within a body of water W. Buoy 10 is basically characterized by a float body 12, a mast 14 extending upwardly from float body 12, a light 16 at the upper end of the mast 12, and a tow bar assembly 18. In preferred form, buoyant body 12 has a maximum diameter at 20 where the lower end of an upper body section 22 joins the upper end of a lower body section 24. Upper body section 22 decreases in diameter as it extends upwardly to the upper end 26 of body 12. In similar fashion, lower body portion 24 decreases in diameter as it extends downwardly to a lower end 28 of body 12. Thus, body portions 22, 24 are conical in shape with their bases joined. Body portion 22 converges as it extends upwardly and body portion 24 converges as it extends downwardly, placing the maximum diameter region 20 intermediate the upper and lower ends 26, 28 of the body 12.

As will hereinafter be described in detail, the body 12 is preferably constructed from a hollow shell. However, it is also possible to construct the body 12 from a solid block of buoyant material, such as a buoyant foam plastic.

The towing bar assembly 18 comprises a control line guide bar 30 having a lower end 32 and an upper end 34. As shown by FIGS. 2 and 4–6, guide bar 30 slopes upwardly and outwardly from its lower end 32 to its upper end 34. It also extends at an acute angle (a) from the side surface of body portion 24. By way of typical and therefore nonlimitive example, angle (a) may rise somewhere between seven to fifteen degrees, and is preferably about ten degrees. Perhaps more imporantly, the slope of guide bar 30 (i.e. angle (b)) is preferably between thirty-five to forty-five degrees. In the illustrated embodiment, angle (b) is about forty degrees. The slope of body portion 24 (i.e. angle (c)) may be about fifty degrees.

The upper end 34 of guide bar 30 merges into a towing bar 36. Towing bar 36 includes a bight 38 which is approximately at the same level as the maximum diameter 20 and is spaced radially outwardly from the maximum diameter 20. Towing bar 36 includes an upper portion 40 which in preferred form is secured to the upper body portion 22, such as by the use of rivets. The lower end 32 of guide bar 30 is connected to a ring 44 which serves to connect the lower end portion of the guide bar 30 to a lower end portion of the buoy 10, in a manner to be hereinafter described.

Figure 4:
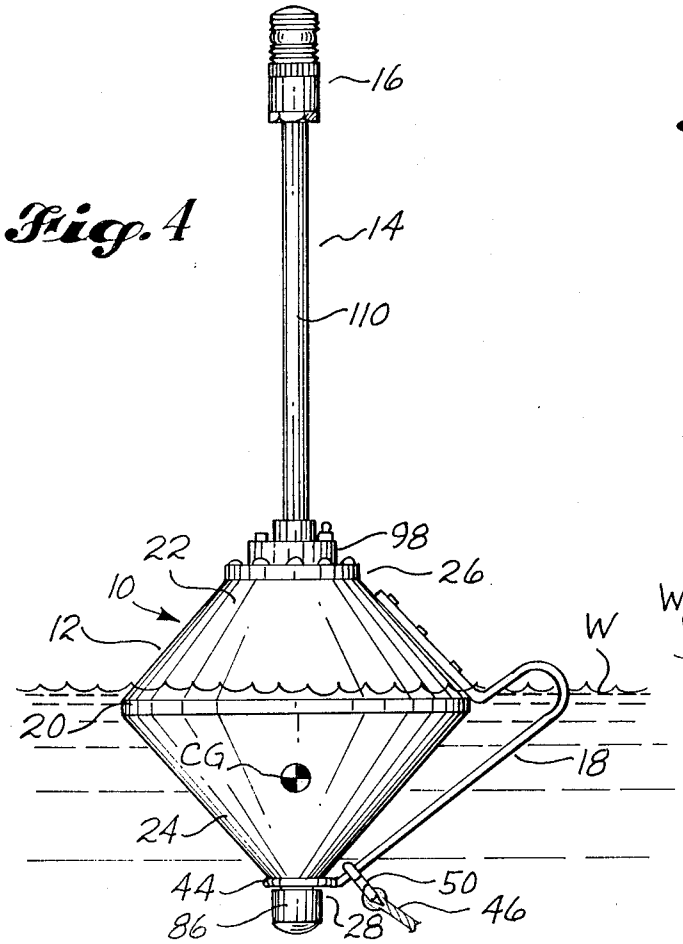
FIG. 4 is a side elevational view of a buoy shown by FIG. 1, in an "at rest" position in the water.

The buoy 10 includes ballast which functions to lower the center of gravity CG to a location below the maximum width zone 20. As shown by FIG. 4, the ballast within body 12, and the buoyancy of body 12, together act to position the body 12 within the water W, with its maximum diameter zone 20 slightly submerged when the buoy 10 is at rest in the water W. In this "at rest" position, the mast 14 is substantially vertical.

A control line 46 is connected to the tow bar assembly 18, such as by means of a shackle or connector eye 50. The connector eye 50 loosely engages the guide bar 30 and when the buoy 10 is in an at rest position in the water W, the eye 50 is positioned at or near the lower end 32 of guide bar 30. Control line 46 may be connected to the end of a net or to an anchor. Owing to the construction of the buoy 10, one can grab hold of the tow line 46 to pull on it for the purpose of moving the buoy 10 in the water W. The first tension applied to line 46 will cause the eye 50 to slide upwardly along the guide bar 30. Sliding will continue until eye 50 engages the bight 38 of the tow bar 36. This engagement occurs at a level which is substantially at the same level of the maximum diameter zone 20. Then, when the line 46 is pulled upon, it will exert a towing force on the buoy 10 at the bight 38. When the buoy 10 starts to move, the water acting on the sloping surface of the lower portion 24 of the body 12 will cause the body 12 to rise into a position placing its maximum width zone 20 at or slightly above the water level. The buoy 10 will remain in a substantially upright position as towing proceeds. This is because of the fact that the towing force is applied to the buoy 10 at about the level of the maximum diameter zone 20.

The mast 14 may carry, in addition to the signal light 16, a radar antenna 52 (FIG. 2) or 54 (FIG. 3).

Figure 8:
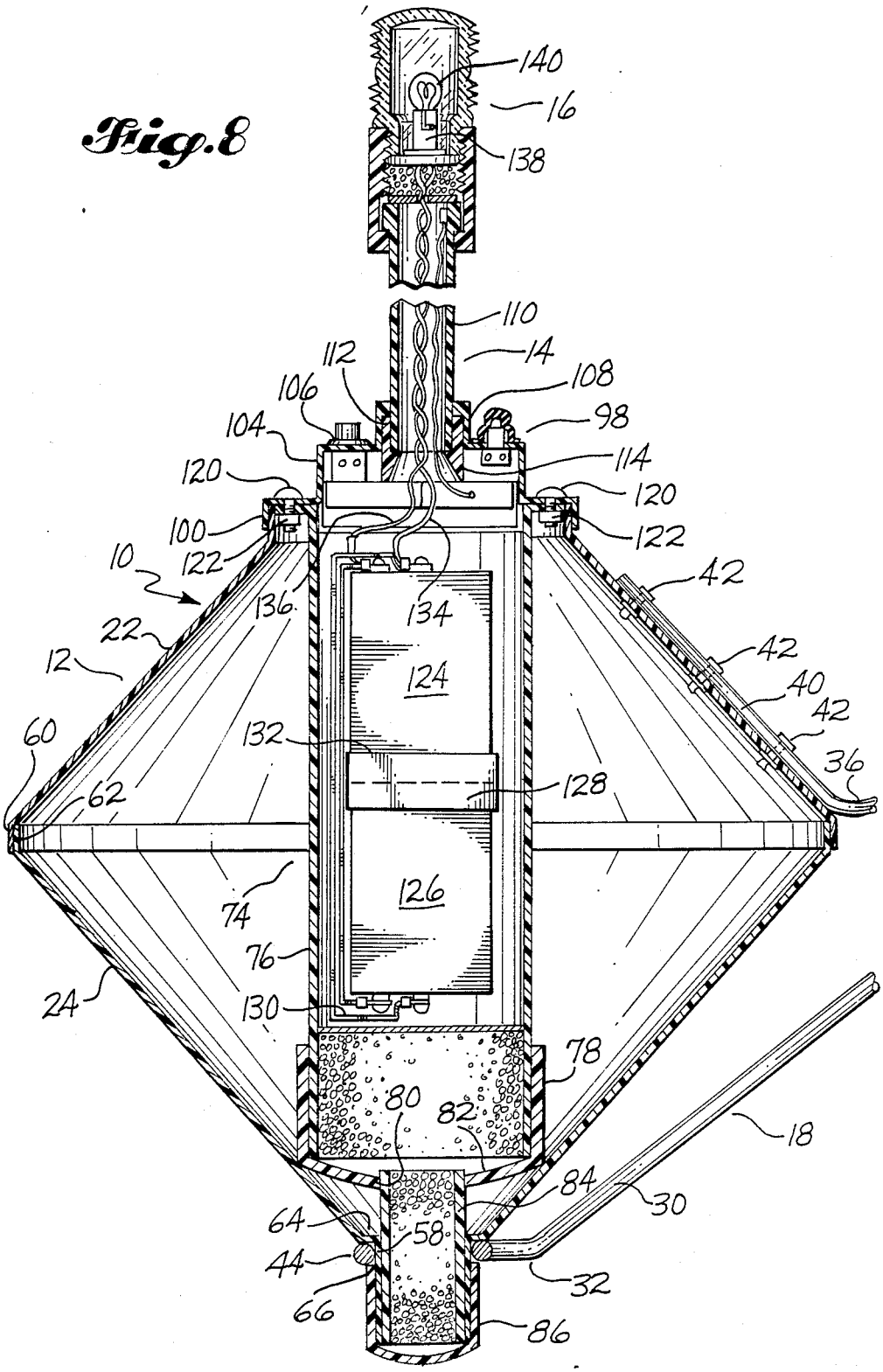
FIG. 8 is a vertical sectional view taken through the buoy, with some internal parts shown in side elevation, such view illustrating a preferred manner of constructing the buoy.

A preferred construction of the buoy 10 will now be described. Referring to FIG. 8, body 12 may be of hollow construction and may include an opening 56 in its upper end 26 and an opening 58 in its lower end 26. Upper housing portion 22 may be a first conical member having a cylindrical flange 60 at its lower end. Housing portion 24 may be a second conical member having a cylindrical flange 62 at its upper end. As best shown in FIG. 8, flange 62 may fit snugly within flange 60 and the two housing portions 22, 24 may be secured together at this location. In preferred form, the housing members 22, 24 are constructed from a structural plastic material. These materials may be glued together where the flanges 60, 62 meet.

The housing part 24 may be formed to include a radial wall 64 surrounding the lower end opening 58 and a cylindrical wall 66 extending axially downwardly from wall 64. The lower end opening 58 extends through cylindrical wall 66. In preferred form, the upper end 26 of housing part 24 is formed to include a radial wall 68. The outer boundary of radial wall 68 is connected to a cylindrical wall 70 which is connected to the conical portion of body part 22. A cylindrical wall 72 may extend axially outwardly from radial wall 68. Cylindrical wall 72 defines at its interior the upper end opening 56 (FIG. 9).

Referring to FIG. 8, an inner housing 74 is positioned within body 12. Inner housing 74 comprises a length of plastic tubing 76 which may gave square cut ends, as shown by FIG. 9. A plastic end cap 78 may be secured to the lower end portion of tube 76. A center opening 80 may be formed in the end wall 82 of cap 78. The upper end of a small diameter plastic tube 84 is snugly received within the opening 80 and is glued to the end wall 82. Tube 84 projects downwardly from end wall 82 through the lower end opening 58 and through the cylindrical wall 66. As best shown by FIG. 8, the ring 44 at the lower end of the tow bar assembly 18 snugly surrounds the cylindrical wall 66. A plastic end cap 86 is positioned on the portion of tube 84 which projects below ring 48. Cap 86 may be glued to the tube 84. Cap 86 functions as a retainer member for both the ring 44 and the lower end of the inner housing 74. The ring 34 is trapped between the upper end of cap 86 and the radial wall 64.

The upper end of tube 76 is positioned generally within the upper end opening 56. A disk-like member 88 sets down on the upper edge 90 of member 76. Member 88 comprises a radial end wall 92, a cylindrical sidewall 94 and an annular flange 96. Flange 96 extends radially outwardly from cylindrical wall 64 and sits down on the edge 90. The cap 98 is provided at the upper end of body 12. Cap 98 comprises a cylindrical wall 100 into which cylindrical wall 70 of housing part 22 is snugly received. Member 98 also includes a radial wall 102 which is connected to cylindrical wall 100 and sets down on the radial wall 68 of housing member 22. Member 98 also includes a cylindrical wall 104 which extends axially from the inner boundary of wall 102. A radial wall 106 is secured to the outer end of cylindrical wall 104. A reduced diameter cylindrical wall 108 extends upwardly from the central portion of wall 106. Wall 108 forms a mounting socket for the base end of the mast 14. As shown by FIG. 8, the mast 14 may comprise a length of tubing 110. The lower end of the tubing 110 may fit into a socket formed in the upper portion of a sleeve 112. Sleeve 112 includes a lower portion 114 which defines a shoulder on which the lower end of tube 110 rests. Tube 110 may be glued to the sleeve 112 and the sleeve 112 may be glued to the cylindrical wall 108. In this manner, the mast 14 becomes permanently secured to the cap 98. Cap 98 is in turn removably secured to the upper end portion of the body 12.

Figure 9:
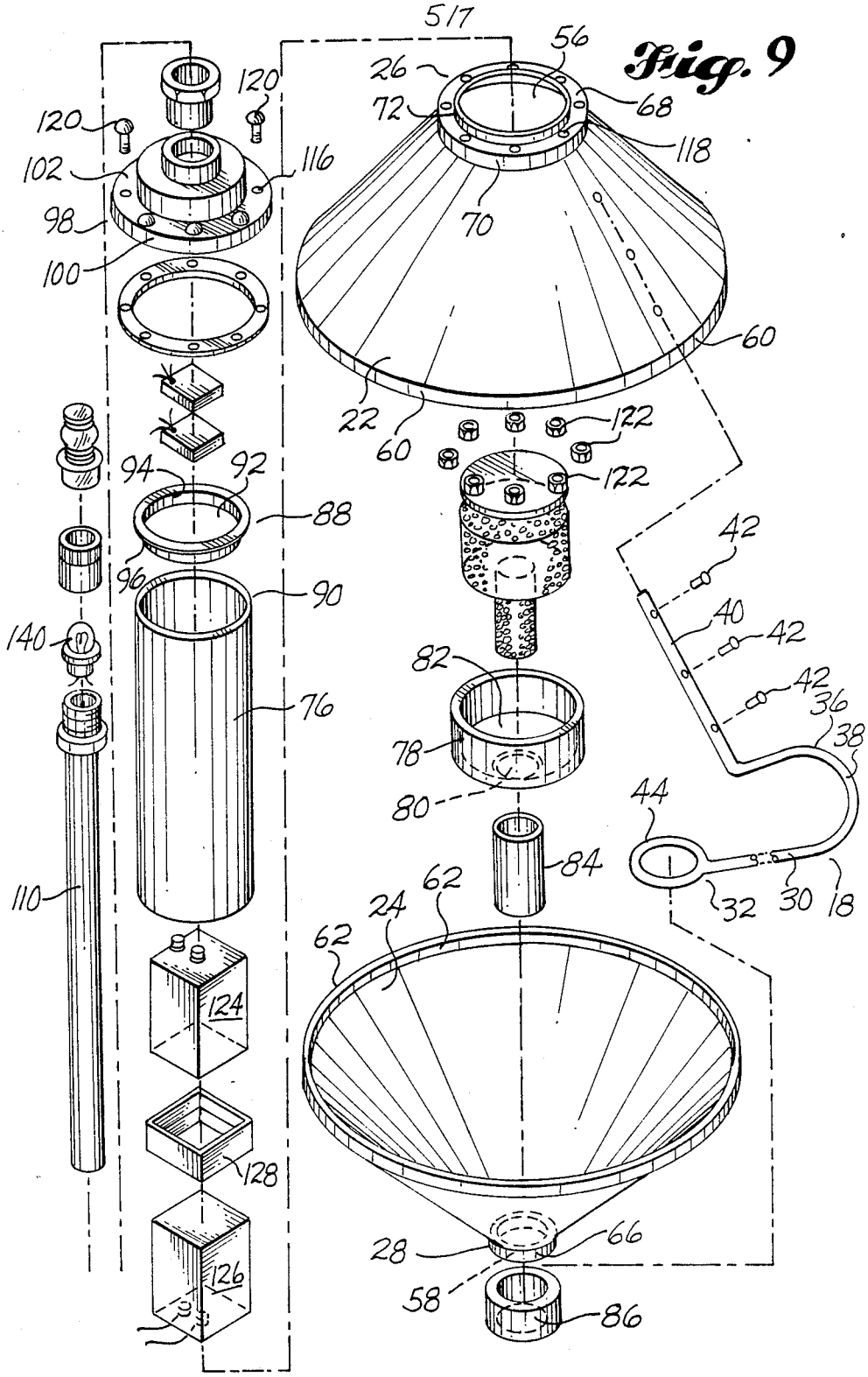
FIG. 9 is an exploded pictorial view of the preferred embodiment.

As shown by FIGS. 8 and 9, wall 102 may be formed to include a circular array of openings 116 which are alignable with a similar circular array of openings 118 in wall 68. Bolts 120 may extend downwardly through openings 118 and then thread into openings 116. The bolts 120 may have flat, rounded or oval heads at their upper ends. Nuts 122 or the like may be embedded in the upper part of housing 12 to provide the threaded openings 116.

In the preferred embodiment, the inner housing 74 contains a pair of batteries 124, 126, each having a base end and a terminal end. In preferred form, the terminal end of battery 124 is directed upwardly and the terminal end of battery 126 is directed downwardly. The base ends of the batteries 124, 126 fit within a connector sleeve 128. A connector 130 connects the positive terminal of battery 126 to the positive terminal of battery 124. In similar fashion, conductor 132 connects the negative terminal of battery 126 to the negative terminal of battery 124. At the upper end of the battery assembly a conductor 1134 extends from the positive terminal up to the positive connection of a lamp base 138 and a negative conductor 136 extends upwardly from the negative terminal to the negative terminal of the lamp base 138.

Figure 10:
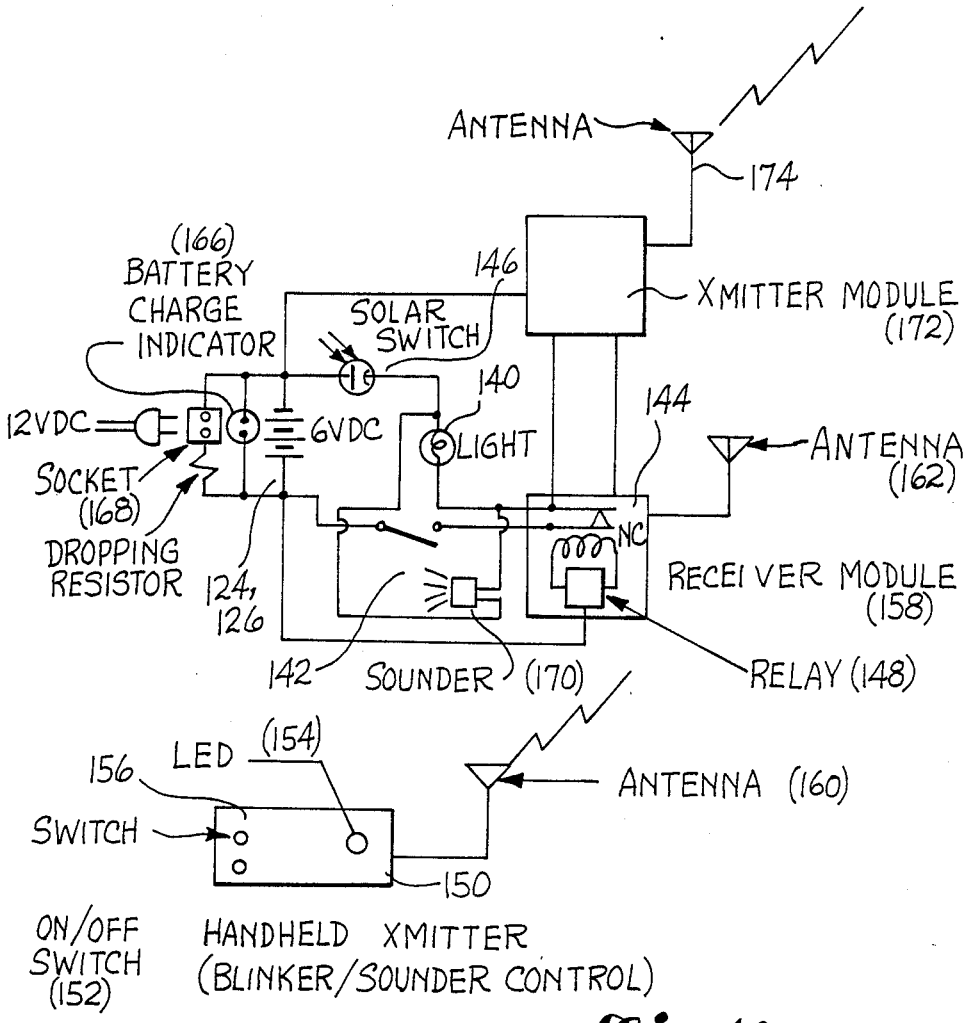
FIG. 10 is a circuit diagram of an embodiment of the invention.

Referring to FIG. 10, the socket base for the light bulb 140 is in a circuit which includes the batteries 124, 126, an off-on switch 142 and a relay switch 144. The off-on switch 142 is a single pole, single throw-type switch. The relay switch 144 is a normally closed switch. In preferred form, the light circuit also includes a solar switch 146. In operation, switch 142 is closed by the person who is placing the buoy in the water. If this is done in the daytime, the light will stay off until it becomes dark enough to energize the solar switch 146. When the solar switch 146 functions in response to darkness, the light 140 is turned on and will stay on until one of the switches 142, 144, 146 is opened. The buoy may be used to mark a fishing line or net in waters which will be crowded with a large number of lines or nets and/or boats. According to an aspect of the invention, a radio-controlled relay 148 is provided in the buoy for opening relay switch 144 in response to a radio signal transmitted from the net over's boat. The transmitter 150 has two switches. The first is an on-off switch 152. Switch 152 is turned on for the purpose of turning on a light 154 on the transmitter 50 which may be a LED. The second switch 156 does two things when it is depressed. It sends a radio signal to a receiver module 158 on the buoy for activating relay 148. It also turns off the light 154. When relay 148 is energized, it opens switch 144. This, in turn, turns off the light 140. The net owner uses this equipment to identify his line or net in the following manner. He holds the transmitter 150 out in from of him with the light 154 positioned towards a lighted buoy in the water distant from the boat. He then pushes switch 156. The light 154 will be turned off. If the buoy light in line with it is also turned off, this means that he has located his line or net. If the buoy light does not turn off, he releases switch 156, to again turn on light 154. Then, the transmitter 150 is repositioned to place its light 154 in general alignment with another buoy light. Then the switch 156 is again depressed. This procedure is repeated until the boat's buoy and line or net are located. As is known to those skilled in the art, the transmitter 150 includes an antenna 160. The receiving module 158 on the boy includes an antenna 162. The transmitter 150 and the receiver module 158, including the relay 148, constitute known technology. Accordingly, these elements are not illustrated in detail.

Figures 6, 7:
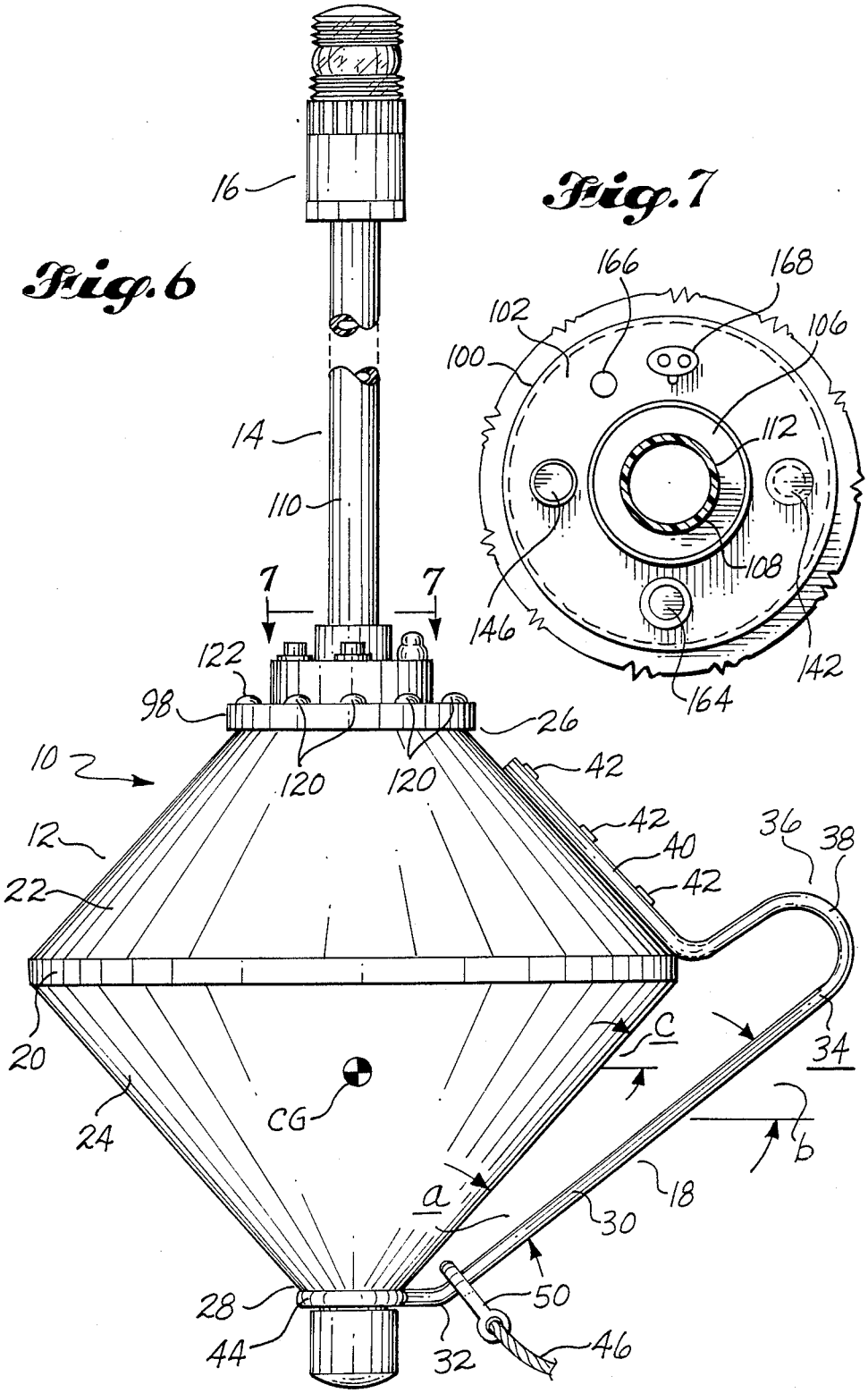
FIG. 6 is an enlarged scale elevational view of the buoy shown by FIGS. 1, 4, and 5, with an intermediate portion of the mast and the bight of the tow bar both omitted.
FIG. 7 is an enlarged scale sectional view taken substantially along line 7—7 of FIG. 6.

Referring to FIG. 7, the solar switch 146 may be mounted on top of member 98. Off-on switch 142 may also be mounted on member 98, together with a gas-release valve 164, a charge indicator light 166 and a recharge socket 168. As is well known, the batteries 124, 126 can be recharged when the buoy is stored aboard the boat, or on land, by connection of a recharge source of electrical energy to the recharge socket 168. Gas-release valve 164 functions to vent battery gases out from the buoy housing.

The buoy may be provided with a horn or other sounder 170, in addition to or in place of the light 140. In FIG. 10, the sounder 170 is shown in the circuit together with the light 140. The sounder 170, if used, would normally be off. However, the method of locating the buoy and line or net would be substantially the same. A person aboard the boat would turn on the transmitter 150 and position the light 154 towards a buoy. He would then depress the switch 156. If the light 154 went off at the same time a sound was heard, this would mean that the boat's buoy had been located.

It is contemplated that a person using the system to locate a buoy and net will turn the switch on and off in accordance with a chosen frequency or pattern of operation. For example, the switch might be depressed and released rapidly a couple of times and then depressed for a longer duration. This would turn the light 140 off and then back on again rapidly for a couple of times followed by it staying off for a longer duration.

One intended use of the buoy is in connection with "long lines". As the name implies, these lines are quite long and they are set with a buoy at each end. The owners have a particulary hard time locating these lines. This is because a long line is normally quite long and can approach or exceed ten miles in length. According to the invention, a buoy may include a transmitter (transponder) module 172 which may be energized by the relay 148 in response to a depressing of the button 156 on hand-held transmitter 152. The relay 148 in this case is a double pole, single throw switch. The light/sounder circuit switch is normally closed. The transponder circuit switch is normally open. The transmitter module 172 is connected to a antenna 174. In the use of a system which includes a transmitter module 172 on the buoy, the person aboard the boat depresses the switch 156. This energizes relay 148 which, in turn, operates switch 144 to turn on the transmitter 172. Transmitter 172 then sends a homing signal which can be used for locating the buoy and the line or net to which it is attached. The transmitter module 172 can be used in place of or in addition to the system which includes the locating light 140 and/or the locating sounder 170. As previously stated, the transmitter homing device is particularly useful for locating buoys that are attached to long lines. The light and/or sounder system is particularly useful of relocating buoys that are attached to gill (drift) nets.

Figures 11, 12:
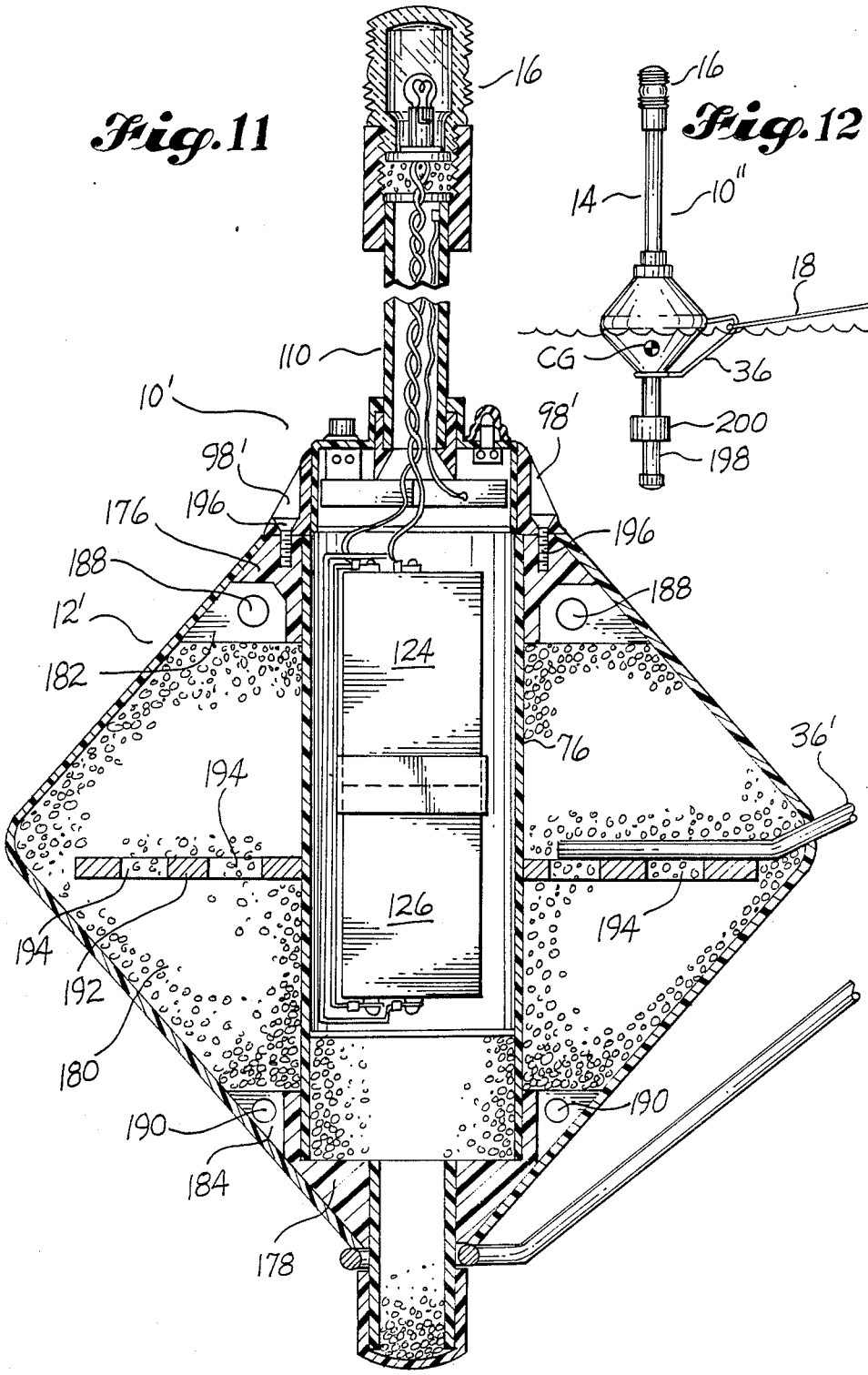
FIG. 11 is a modified construction of the buoy.
FIG. 12 is a further modified construction of the buoy.

FIG. 11 shows a modified construction of the buoy. The buoy body 12' is formed to include end fittings 176, 178 at its upper and lower ends, respectively. The inner tubular housing 76 is attached at its ends to the end fittings 176, 178. A solid body of foam plastic 180 is cast about the tube 76, between the end fittings 176, 178. The outer surface of the body 180 may be covered with a tough film plastic coating or layer. The end fittings 176, 178 may comprise radial regions 182, 184 which include openings 188, 190 through which the foam plastic extends. Also, the upper end of the towing bridle 36' may extend into the body 12' and be welded or otherwise attached to a metal anchor plate 192. Plate 192 may also include openings 194 for receiving some of the foam, for purposes of better anchoring the plate 192 in the foam body. In this embodiment, the member 98 is secured to the upper end fitting 176 such as by securement screws 196.

FIG. 12 shows a further modified form of buoy 10''. It includes a downwardly extending post portion 198 onto which one or more weights 200 are secured. The size and number of the weights 200, and their positions on the post 198, will determine the position of the center of gravity 10''. The post 198 is weighted to effectively counterbalance the mast 14. The longer the mast 14, the longer the post 198, or the lower the positioning of the weight 200 on the post 198.

The embodiments which have been illustrated and described are preferred embodiments. However, the invention is not to be limited to these embodiments but is to be determined by the claims which follow, interpreted in accordance with established rules of patent claim interpretation, including use of the doctrine of equivalents.

What is claimed is:

1. A towable buoy comprising:

a float body having an upper end and a lower end and including a generally conical upper portion having a small upper end and a large lower end, and a generally conical lower portion having a large upper end and a small lower end, said lower end of said upper portion being joined to the upper end of said lower portion, providing the float body with a maximum diameter where the upper and lower portions join;

a control line guide bar connected to said buoy, said guide bar having a lower end adjacent the lower end of said flat body, and an upper end, and said guide bar sloping upwardly and outwardly from its lower end to its upper end;

a tow bar connected to the upper end of the guide bar and presenting a bight spaced radially outwardly from the maximum diameter of the float body;

a ballast weight providing the buoy with a center of gravity located below said maximum diameter of said flat body; and a control line having a buoy end slidably connected to said guide bar, for sliding in position along said guide bar, said control line having a first position wherein said buoy end of the control line is at the lower end of said guide bar, and a second position in which said towing line is in tension and said buoy end engages said bight of said tow bar;

wherein when a towing force is first applied to the tow line the buoy end of the tow line will slide in position upwardly along the guide bar into a position of engagement with the bight of said tow bar, and then when the tow line is pulled upon an additional amount it will exert a towing force acting on said buoy substantially at the maximum diameter of the float body.

2. A towable buoy according to claim 1, wherein the two bar includes an upper portion which is connected to said buoy.

3. A towable buoy according to claim 2, wherein said upper portion of the tow bar is connected to the upper portion of said float body.

4. A towable buoy according to claim 1, comprising a connector at the lower end of the guide bar which engage said buoy below said float body.

5. A towable buoy according to claim 4, wherein said buoy includes a tubular portion projecting below the flat body and the connector at the lower end of the guide bar is a ring which surrounds said tubular portion of the buoy.

6. A towable buoy according to claim 1, further comprising a mast projecting upwardly from said flat body, said mast including a base which is removable attached to the upper end of said float body.

7. A towable buoy according to claim 1, wherein said float body is hollow, further comprising an opening at the lower end of said float body, an inner housing within said flat body having a tubular lower end portion which extends downwardly through and beyond said opening, and an end member below said float body secured to said tubular lower end portion, said end member being larger than said opening at the lower end of the float.

8. A towable buoy according to claim 7, wherein said guide bar includes a ring at its lower end which surrounds said tubular lower end portion and is positioned between said end member and the lower end of said float body.

9. A towable buoy according to claim 7, wherein said ballast weight is within a lower portion of said inner housing.

10. A towable buoy according to claim 7, comprising battery means in said inner housing and a light carried by said buoy which is energized by said battery means.

11. A towable buoy according to claim 10, wherein said ballast weight is within said inner housing below the battery means.

12. A towable buoy according to claim 1, wherein said float body is hollow, further comprising an opening in the lower end of said float body, a larger opening in the upper end of said float body, an inner housing insertable into said float body through the opening in the upper end of the float body, said inner housing including a tubular lower end portion which is sized to fit through the opening in the lower end of the float body and is above said tubular lower end portion substantially larger than the opening in the lower end of the float body, wherein the space within the float body surrounding said inner housing is a bouyancy chamber, and wherein the ballast weight is located within said inner housing.

13. A towable buoy according to claim 12, further comprising a mast projecting upwardly from said float body, said mast including a base which is removable attached to the upper end of said float body and when attached functions to secure the inner housing in place within said float body.

14. A towable buoy according to claim 13, said mast including an upper end, and said buoy further comprising a light at the upper end of the mast, battery means within said inner housing, and circuitry means interconnecting the battery means and said light.

15. A towable buoy according to claim 14, wherein the circuitry includes an off-on control which is mounted on the base of said mast.

16. A towable buoy according to claim 1, comprising a battery housing within said float body, a pair of batteries within said battery housing, one of said batteries having a terminal end directed downwardly and the other battery having a terminal end directed upwardly, each terminal end including a positive terminal and a negative terminal, a connector interconnecting the two batteries where the batteries meet, a light carried by said buoy, and circuitry means connecting the terminals of the batteries to said light.

17. A marine buoy, comprising:

a hollow float body including an upper end, a lower end, a relatively large opening in the upper end and a relatively small opening in the lower end;

an inner housing within said hollow float body, said inner housing being sized to fit through the opening in the upper end of the hollow float body, said inner housing including a tubular lower end portion sized to fit through the opening in the lower end of the hollow float body and extend below the hollow body, wherein a buoyancy chamber is defined by and between the inner housing and the hollow float body, about said inner housing;

a retainer member secured to the tubular lower end portion following insertion of the inner housing into said hollow float body and insertion of the tubular lower end portion through the opening in the lower end of the hollow float body, said retainer member being larger than the opening in the lower end of the hollow float body;

a removable cap member secured to the upper end of the hollow float body following insertion of the inner housing into the hollow body, said cap member securing said inner housing in place within said hollow float body;

a mast having a lower end connected to said cap member and an upper end;

a signal light at the upper end of said mast;

battery means within said inner housing; and circuitry interconnecting the battery means and the signal light, said circuitry including an off-on control for the signal light mounted on the cap member.

18. A marine buoy according to claim 17, wherein said hollow body includes an annular end wall at said upper end surrounding the opening in the upper end, and said cap includes a wall resting on said annular end wall, and said buoy includes fasteners extending through the two walls for connecting the cap to the hollow body.

19. A marine buoy according to claim 17, comprising a space defined between the cap and said battery means and said circuitry includes control components within said space.

* * * * *

UNITED STATES PATENT AND TRADEMARK OFFICE

CERTIFICATE OF CORRECTION

PATENT NO. : 4,896,620

DATED : January 30, 1990

INVENTOR(S) : Harry E. Jones

It is certified that error appears in the above-identified patent and that said Letters Patent is hereby corrected as shown below:

Col. 2, line 22 "hollow buoy" should be -- hollow body --.

Col. 5, line 39, "gave" should be -- have --.

Col. 6, line 60, "over's" should be -- owner's --.

Col. 7, line 15, "boy" should be -- buoy --.

Col. 8, line 7, "of" should be -- for --.

Claim 1, col. 8, in lines 56 and again in 64, "flat" should be -- float --.

UNITED STATES PATENT AND TRADEMARK OFFICE

CERTIFICATE OF CORRECTION

PATENT NO. : 4,896,620

DATED : January 30, 1990

INVENTOR(S) : Harry E. Jones

It is certified that error appears in the above-identified patent and that said Letters Patent is hereby corrected as shown below:

Claim 2, col. 9, line 13, "two" should be -- tow --.

Claim 4, col. 9, line 20, "engage" should be -- engages --.

Claim 5, col. 9, line 23, "flat" should be -- float --.

Claim 6, col. 9, line 27, "flat" should be -- float --; and in line 28, "removable" should be -- removably --.

Claim 7, col. 9, line 33, "flat" should be -- float --.

Claim 13, col. 10, line 1, "removable" should be -- removably -.

Column 8, line 7, "relocating" should be --locating--.

Signed and Sealed this

Seventh Day of January, 1992

*Attest:*

*Attesting Officer*

HARRY F. MANBECK, JR.

*Commissioner of Patents and Trademarks*